US007306662B2

(12) United States Patent
Vaskelis et al.

(10) Patent No.: US 7,306,662 B2
(45) **Date of Patent: *Dec. 11, 2007**

(54) PLATING SOLUTION FOR ELECTROLESS DEPOSITION OF COPPER

(75) Inventors: Algirdas Vaskelis, Vilnius (LT); Eugenijus Norkus, Vilnius (LT); Jane Jaciauskiene, Vilnius (LT); Aldona Jagminiene, Vilnius (LT)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/382,906

(22) Filed: May 11, 2006

(65) Prior Publication Data

US 2007/0261594 A1 Nov. 15, 2007

(51) Int. Cl.
*C23C 18/38* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS 3,403,035 A * 9/1968 Schneble, Jr. et al. ... 427/443.1
3,935,013 A * 1/1976 Lelental ..... 430/16
4,143,186 A * 3/1979 Davis ..... 427/345
4,265,943 A * 5/1981 Goldstein et al. ..... 427/305
4,301,196 A * 11/1981 McCormack et al. ..... 427/99.1
4,303,443 A * 12/1981 Miyazawa et al. ..... 106/1.23
4,450,191 A * 5/1984 Arcilesi ..... 427/443.1
4,482,596 A * 11/1984 Gulla et al. ..... 428/131
4,650,691 A * 3/1987 Kinoshita et al. ..... 427/8
6,911,068 B2 * 6/2005 Cobley et al. ..... 106/1.25
2007/0048447 A1 * 3/2007 Lee et al. ..... 427/305

OTHER PUBLICATIONS

A. Vaskelis, H.J. Norkus, G. Rozovskis, H.J. Vinkevicius, "New Methods of Electroless Plating and Direct Electroplating of Plastics", *Trans IMF*, 1997 pp. 1-3, no month.

A. Vaskelis, E. Norkus, J. Jaciauskiene, "Kinetics of Electroless Copper Deposition Using Cobalt(II)- Ethylenediamine Complex Compounds as Reducing Agents", *Department of Chemical Kinetics and Catalysis, Institute of Chemistry* 2002 pp. 297-303, no month.

A. Vaskelis, E. Norkus, A. Jagminiene, L. Tamasauskaite-Tamasiunaite, "Electroless Silver Plating at Elevated Temperature Using Cobalt(II)- Ammonia Complex Compounds as Reducing Agents", *Institute of Chemistry*, 1998 pp. 105-108, no month available.

A. Vaskelis, E. Norkus, "Autocatalytic Process of Copper (II) and Silver(I) Reduction by Cobalt (II) Complexes", *Institute of Chemistry*, 1998, pp. 3667-3677, no month.

A. Vaskelis, J. Jaciauskiene, A. Jagminiene, E. Norkus, "Obtaining of IB Group Metal Films by Novel Electroless Deposition Method", *Institute of Chemistry*, 2002, pp. 1299-1304, no month available.

* cited by examiner

*Primary Examiner*—Helene Klemanski
(74) *Attorney, Agent, or Firm*—Martine Penilla & Gencarella, LLP

(57) ABSTRACT

An electroless copper plating solution is disclosed herein. The solution includes an aqueous copper salt component, an aqueous cobalt salt component, a triamine based complexing agent, and an acidic pH-modifying substance in an amount sufficient to make the electroless copper plating solution acidic. A method of preparing an electroless copper solution is also provided.

20 Claims, No Drawings

PLATING SOLUTION FOR ELECTROLESS DEPOSITION OF COPPER

BACKGROUND

In the fabrication of semiconductor devices such as integrated circuits, memory cells, and the like, a series of manufacturing operations are performed to define features on semiconductor wafers ("wafers"). The wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

To build an integrated circuit, transistors are first created on the surface of the wafer. The wiring and insulating structures are then added as multiple thin-film layers through a series of manufacturing process steps. Typically, a first layer of dielectric (insulating) material is deposited on top of the formed transistors. Subsequent layers of metal (e.g., copper, aluminum, etc.) are formed on top of this base layer, etched to create the conductive lines that carry the electricity, and then filled with dielectric material to create the necessary insulators between the lines.

Although copper lines are typically comprised of a PVD seed layer (PVD Cu) followed by an electroplated layer (ECP Cu), electroless chemistries are under consideration for use as a PVD Cu replacement, and even as a ECP Cu replacement. A process called electroless copper deposition can thus be used to build the copper conduction lines. During electroless copper deposition electrons are transferred from a reducing agent to the copper ions in the solution resulting in the deposition of reduced copper onto the wafer surface. The formulation of the electroless copper plating solution is optimized to maximize the electron transfer process involving the copper ions in solution.

Conventional formulations call for maintaining the plating solution at a high alkaline pH (i.e., pH>9). The limitations with using highly alkaline copper plating solutions for electroless copper deposition are non-compatibility with positive photoresist on the wafer surface, longer induction times, and decreased nucleation density due to an inhibition by hydroxylation of the copper interface (which occurs in a neutral-to-alkaline environment). These are limitations that can be eliminated if the solution is maintained at an acidic pH environment.

In view of the forgoing, there is a need for improved formulations of copper plating solutions that can be maintained in a low acidic pH environment for use in electroless copper deposition processes.

SUMMARY

Broadly speaking, the present invention fills these needs by providing improved formulations of copper plating solutions that can be maintained in an acidic pH environment for use in electroless copper deposition processes. It should be appreciated that the present invention can be implemented in numerous ways, including as a method and a chemical solution. Several inventive embodiments of the present invention are described below.

In one exemplary embodiment, an electroless copper plating solution is disclosed. The solution includes an aqueous copper salt component, an aqueous cobalt salt component, a triamine based complexing agent, and a pH-modifying substance. In another embodiment, the electroless copper plating solution includes an aqueous copper salt component with a concentration range between about 0.001 molarity (M) to the salt solubility limit. In yet another embodiment, the electroless copper plating solution includes an aqueous cobalt salt component with a concentration range between about 0.001 molarity (M) to the salt solubility limit. In still another embodiment, an electroless copper plating solution includes a complexing agent having a triamine group with a concentration range between about 0.005 molarity (M) to 10.0M.

In another aspect of the invention, a method for preparing an electroless copper plating solution is disclosed. The method involves combining the aqueous copper salt component, a portion of the complexing agent component and the acid component of the plating solution into a first mixture. The aqueous cobalt salt component and the remainder of the complexing agent is combined into a second mixture. Prior to use in an electroless copper deposition operation, the first mixture and second mixture are combined.

DETAILED DESCRIPTION

An invention is described for providing improved formulations of copper plating solutions that can be maintained in an acidic pH environment for use in electroless copper deposition processes. It will be obvious, however, to one skilled in the art, that the present invention may be practiced without some or all of these specific details. In other instances, well known process operations have not been described in detail in order not to unnecessarily obscure the present invention.

Electroless metal deposition processes used in semiconductor manufacturing applications are based upon simple electron transfer concepts. The processes involve placing a prepared semiconductor wafer into an electroless metal plating solution bath then inducing the metal ions in the solution to accept electrons from a reducing agent resulting in the deposition of the reduced metal onto the surface of the wafer. The success of the electroless metal deposition process is highly dependent upon the various physical (e.g., temperature, etc.) and chemical (e.g., pH, reagents, etc.) parameters of the plating solution. As used herein, a reducing agent is an element or compound in an oxidation-reduction reaction that reduces another compound or element. In doing so, the reducing agent becomes oxidized. That is, the reducing agent is an electron donor that donates an electron to the compound or element being reduced.

A complexing agent (i.e., chelators or chelating agent) is any chemical agent that can be utilized to reversibly bind to compounds and elements to form a complex. A salt is any ionic compound composed of positively charged cations (e.g., $Cu^{2+}$, etc.) and negatively charged anions, so that the product is neutral and without a net charge. A simple salt is any salt species that contain only one kind of positive ion (other than the hydrogen ion in acid salts). A complex salt is any salt species that contains a complex ion that is made up of a metallic ion attached to one or more electron-donating molecules. Typically a complex ion consists of a metallic atom or ion to which is attached one or more electron-donating molecules (e.g., Cu(II)ethylenediamine$^{2+}$, etc.). A protonized compound is one that has accepted a hydrogen ion (i.e., $H^+$) to form a compound with a net positive charge.

A copper plating solution for use in electroless copper deposition applications is disclosed below. The components of the solution are a copper(II) salt, a cobalt(II) salt, and a polyamine-based complexing agent. In one exemplary embodiment, the copper plating solution is prepared using de-oxygenated liquids. Use of de-oxygenated liquids substantially eliminates oxidation of the wafer surfaces and nullifies any effect that the liquids may have on the redox potential of the final prepared copper plating solution.

In one embodiment, the copper(II) salt is a simple salt. Examples of simple copper(II) salts include copper(II) sulfate, copper (II) nitrate, copper(II) chloride, copper(II) tetrafluoroborate, copper(II) acetate, and mixtures thereof. It should be appreciated that essentially any simple salt of copper(II) can be used in the solution so long as the salt can be effectively solubilized into solution, be complexed by a polyamine-based complexing agent, and oxidized by a reducing agent in an acidic environment to result in deposition of the reduced copper onto the surface of the wafer.

In one embodiment, the copper(II) salt is a complex salt with a polyamine electron-donating molecule attached to the copper(II) ion. Examples of complex copper(II) salts include copper(II) ethylenediamine sulfate, bis(ethylenediamine) copper(II) sulfate, copper (II)diethylenetriamine nitrate, bis(diethylenetriamine)copper(II) nitrate, and mixtures thereof. It should be appreciated that essentially any complex salt of copper(II) attached to a polyamine molecule can be used in the solution so long as the resulting salt can be solubilized into solution, be complexed to a polyamine-based complexing agent, and oxidized by a reducing agent in an acidic environment to result in deposition of the reduced copper onto the surface of the wafer.

In one embodiment, the concentration of the copper(II) salt component of the copper plating solution is maintained at a concentration of between about 0.0001 molarity (M) and the solubility limit of the various copper(II) salts disclosed above. In another exemplary embodiment, the concentration of the copper(II) salt component of the copper plating solution is maintained at between about 0.01 M and 10.0 M. It should be understood that the concentration of the copper (II) salt component of the copper plating solution can essentially be adjusted to any value up to the solubility limit of the copper(II) salt as long as the resulting copper plating solution can effectuate electroless deposition of copper on a wafer surface during an electroless copper deposition process.

In one embodiment, the cobalt(II) salt is a simple cobalt salt. Examples of simple cobalt(II) salts include cobalt(II) sulfate, cobalt(II) chloride, cobalt(II) nitrate, cobalt(II) tetrafluoroborate, cobalt(II) acetate, and mixtures thereof. It should be understood that essentially any simple salt of cobalt(II) can be used in the solution so long as the salt can be effectively solubilized in the solution, be complexed to a polyamine-based complexing agent, and reduce a cobalt(II) salt in an acidic environment to result in the deposition of the reduced copper onto the surface of the wafer.

In another embodiment, the cobalt(II) salt is a complex salt with a polyamine electron-donating molecule attached to the cobalt(II) ion. Examples of complex cobalt(II) salts include cobalt(II) ethylenediamine sulfate, bis(ethylenediamine)cobalt(II) sulfate, cobalt(II) diethylenetriamine nitrate, bis(diethylenetriamine)cobalt(II) nitrate, and mixtures thereof. It should be understood that essentially any simple salt of cobalt(II) can be used in the solution so long as the salt can be effectively solubilized into solution, be complexed to a polyamine-based complexing agent, and reduce a copper(II) salt in an acidic environment to result in the deposition of the reduced copper onto the surface of the wafer.

In one embodiment, the concentration of the cobalt(II) salt component of the copper plating solution is maintained at between about 0.0001 molarity (M) and the solubility limit of the various cobalt(II) salt species disclosed above. In one exemplary embodiment, the concentration of the cobalt (II) salt component of the copper plating solution is maintained at between about 0.01 M and 1.0 M. It should be understood that the concentration of the cobalt(II) salt component of the copper plating solution can essentially be adjusted to any value up to the solubility limit of the cobalt(II) salt as long as the resulting copper plating solution can effectuate electroless deposition of copper on a wafer surface at an acceptable rate during an electroless copper deposition process.

In one embodiment, the polyamine-based complexing agent is a diamine compound. Examples of diamine compounds that can be utilized for the solution include ethylenediamine, propylenediamine, 3-methylenediamine, and mixtures thereof. In another embodiment, the polyamine-based complexing agent is a triamine compound. Examples of triamine compounds that can be utilized for the solution include diethylenetriamine, dipropylenetriamine, ethylene propylenetriamine, and mixtures thereof. It should be understood that essentially any diamine or triamine compound can be used as the complexing agent for the plating solution so long as the compound can complex with the free metal ions in the solution (i.e., copper(II) metal ions and cobalt(II) metal ions), be readily solubilized in the solution, and be protonized in an acidic environment. In one embodiment, other chemical additives including levelers (amine-conating compounds such as the azo dyes (i.e. Janus Green), accelerators (i.e., SPS, sulfopropyl sulfonate) and suppressors (i.e., PEG, polyethylene glycol) are included in the copper plating solution at low concentrations to enhance the application specific performance of the solution.

In another embodiment, the concentration of the complexing agent component of the copper plating solution is maintained at between about 0.0001 molarity (M) and the solubility limit of the various diamine-based or triamine-based complexing agent species disclosed above. In one exemplary embodiment, the concentration of the complexing agent component of the copper plating solution is maintained at between about 0.005 M and 10.0 M, but must be greater than the total metal concentration in solution.

Typically, the complexing agent component of a copper plating solution causes the solution to be highly alkaline and therefore somewhat unstable (due to too large a potential difference between the copper(II)-cobalt(II) redox couple). In one exemplary embodiment, an acid is added to the plating solution in sufficient quantities to make the solution acidic with a pH≦about 6.4. In another embodiment, a buffering agent is added to make the solution acidic with a pH≦about 6.4 and to prevent changes to the resulting pH of the solution after adjustment. In still another embodiment, an acid and/or a buffering agent is added to maintain the pH of the solution at between about 4.0 and 6.4. In yet another embodiment, an acid and/or a buffering agent is added to maintain the pH of the solution at between about 4.3 and 4.6. In one embodiment, the anionic species of the acid matches the respective anionic species of the copper(II) and cobalt (II) salt components of the copper plating solution, however it should be appreciated that the anionic species do not have to match.

Acidic copper plating solutions have many operational advantages over alkaline plating solutions when utilized in an electroless copper deposition application. An acidic copper plating solution can inhibit the generation of $H_2$ as the copper(II)-cobalt(II) redox reaction takes place within the solution. This reduces void or occlusion formation in the copper layer that is deposited on the wafer surface. Further, an acidic copper plating solution improves the adhesion of the reduced copper ions that are deposited on the wafer surface. This is often a problem observed with alkaline copper plating solutions due to the formation of hydroxyl-terminated groups, inhibiting the nucleation reaction and causing reduced nucleation density, larger grain growth and increased surface roughness. Still further, for applications such as direct patterning of copper lines by electroless deposition of copper through a patterned film, an acidic copper plating solution helps improve selectivity over the barrier and mask materials on the wafer surface, and allows the use of a standard positive resist photomask resin material that would normally dissolve in a basic solution.

In addition to the advantages discussed above, copper deposited using the acidic copper plating solutions exhibits lower pre-anneal resistance characteristics than with copper deposited using alkaline copper plating solutions. It should be appreciated that the pH of the copper plating solutions, as disclosed herein, can essentially be adjusted to any acidic (i.e., pH≦7.0) environment so long as the resulting deposition rates of copper during the electroless copper deposition process is acceptable for the targeted application and the solution exhibits all the operational advantages discussed above. In general, as the pH of the solution is lowered (i.e., made more acidic), the copper deposition rate decreases. However, varying the choice of complexing agent (i.e., diamine-based and triamine-based compounds) plus the concentration of the copper (II) and cobalt(II) salts can help compensate for any reduction in copper deposition rate resulting from an acidic pH environment.

In one embodiment, the copper plating solution is maintained at a temperature between about 0° Celsius (° C.) and 70° C. during an electroless copper deposition process. In one exemplary embodiment, the copper plating solution is maintained at a temperature of between about 20° C. and 70° C. during the electroless copper deposition process. It should be appreciated that temperature impacts the nucleation density and deposition rate of copper (mainly, the nucleation density and deposition rate of copper is directly proportional to temperature) to the wafer surface during copper deposition. The deposition rate impacts the thickness of the resulting copper layer and the nucleation density impacts void space, occlusion formation within the copper layer, and adhesion of the copper layer to the underlying barrier material. Therefore, the temperature settings for the copper plating solution during the electroless copper deposition process would be optimized to provide dense copper nucleation and controlled deposition following the nucleation phase of the bulk deposition to optimize the copper deposition rate to achieve copper film thickness targets.

This invention will be further understood by reference to the following examples in Table 1, which include several embodiments of the present invention.

TABLE 1

| Plating Solution A (pH = 4.3) | Plating Solution A Formulation |
|---|---|
| 0.05 M $Cu(NO_3)_2$ | 11.2 milliliters (mL) [$H_2O$] |
| 0.6 M Diethylenetriamine | 1 mL [$Cu(NO_3)_2$ 1 M] |
| 0.15 M $Co(NO_3)_2$ | 3.5 mL [$HNO_3$ 5 M] |
| | 1.3 mL [Diethylenetriamine 99%] |
| | Argon Gas |
| | 3.0 mL [$Co(NO_3)_2$ 1 M] |

TABLE 1-continued

| Plating Solution B (pH = 4.6) | Plating Solution B Formulation |
|---|---|
| 0.05 M $Cu(NO_3)_2$ | 11.7 mL [$H_2O$] |
| 0.6 M Diethylenetriamine | 1 mL [$Cu(NO_3)_2$ 1 M] |
| 0.15 M $Co(NO_3)_2$ | 3.0 mL [$HNO_3$ 5 M] |
| | 1.3 mL [Diethylenetriamine 99%] |
| | Argon Gas |
| | 3.0 mL [$Co(NO_3)_2$ 1 M] |
| **Plating Solution C (pH = 5.4)** | **Plating Solution C Formulation** |
| 0.05 M $Cu(BF_4)_2$ | 13.2 mL [$H_2O$] |
| 0.6 M Diethylenetriamine | 1.0 mL [$Cu(BF_4)_2$ 1 M] |
| 0.15 M $Co(BF_4)_2$ | 1.0 mL [$HBF_4$ 5 M] |
| | 1.3 mL [Diethylenetriamine 99%] |
| | Argon Gas |
| | 3.53 mL [$Co(BF_4)_2$ 1 M] |
| **Plating Solution D (pH = 6.15)** | **Plating Solution D Formulation** |
| 0.05 M $Cu(BF_4)_2$ | 13.47 mL [$H_2O$] |
| 0.6 M Diethylenetriamine | 1.0 mL [$Cu(BF_4)_2$ 1 M] |
| 0.15 M $Co(BF_4)_2$ | 0.7 mL [$HBF_4$ 5 M] |
| | 1.3 mL [Diethylenetriamine 99%] |
| | Argon Gas |
| | 3.53 mL [$Co(BF_4)_2$ 1 M] |

As shown above in Table 1, in one exemplary embodiment (i.e., Plating Solution A), a copper nitrate/diethylenetriamine plating solution is disclosed with a pH of 4.3 and including 0.05M $Cu(NO_3)_2$, 0.6M Diethylenetriamine, and 0.15M $Co(NO_3)_2$. In another embodiment (i.e., Plating Solution B), the copper nitrate/diethylenetriamine plating solution is disclosed with a pH of 4.6 and including 0.05M $Cu(NO_3)_2$, 0.6M Diethylenetriamine, and 0.15M $Co(NO)_3)_2$. It should be understood that the concentrations of the $Cu(NO_3)_2$, Diethylenetriamine, and $Co(NO_3)_2$ components of the copper nitrate/diethylenetriamine plating solution can be adjusted to any value up to the solubility limit of the components so long as the resulting solution can effectuate an acceptable copper deposition rate for the pH setting of the solution.

In one exemplary embodiment of the present invention, the formulation (i.e. Plating Solution A Formulation) of Plating Solution A is disclosed. It should be appreciated that the order in which the various chemical components of a plating solution are mixed during formulation impacts the copper plating performance of the resulting solution. In this exemplary embodiment, a 20 milliliter (mL) batch of Plating Solution A is formulated by initially adding about 11.2 mL of water ($H_2O$) to an appropriately sized container followed by about 1.0 mL of 1M $Cu(NO_3)_2$ solution, about 3.5 mL of 5M $HNO_3$ solution and about 1.3 mL of Diethylenetriamine (99%). At this point in the formulation the copper ions released by the $Cu(NO_3)_2$ component are complexed with the Diethylenetriamine molecules in the mixture. The resulting mixture is then deoxygenated using an inert gas such as Argon gas introduced to the mixture prior to adding $Co(NO_3)_2$ solution to prevent the premature oxidation of the cobalt element of the $Co(NO_3)_2$ solution. It should be understood that Argon gas can be delivered to the mixture using any commercially available gas sparging system so long as the gas is delivered in sufficient quantities to deoxygenate the mixture to the required level for the electroless copper deposition application. It should be appreciated that other types of inert gas (e.g., $N_2$, etc.) can also be used as long as the gas does not interfere with the electroless copper deposition process. Finally, about 3.0 mL of $Co(NO_3)_2$ solution is added to the mixture to complete the formulation of Plating Solution A.

Continuing with Table 1, in another embodiment, the formulation (i.e. Plating Solution B Formulation) of Plating Solution B is disclosed. In this embodiment, a 20 milliliter (mL) batch of Plating Solution B is formulated by initially adding about 11.7 mL of water ($H_2O$) to an appropriately sized container followed by about 1.0 mL of 1M $Cu(NO_3)_2$ solution, about 3.0 mL of 5M $HNO_3$ solution and about 1.3 mL of Diethylenetriamine (99%). The resulting mixture is then deoxygenated using Argon gas introduced to the mixture prior to the addition of about 3.0 mL of 1M $Co(NO_3)_2$ solution to complete the formulation of Plating Solution B.

In one embodiment, an electroless copper plating solution is prepared by first pre-mixing a portion of the complexing agent component with the copper salt component, acid component, and water into a into a first pre-mixed solution. The remaining portion of the complexing agent component is pre-mixed with the cobalt salt component into a second pre-mixed solution. The first premixed solution and second pre-mixed solution are then added into an appropriate container for final mixing into the final electroless copper plating solution prior to use in an electroless copper deposition operation.

Still referring to Table 1, in one embodiment (i.e., Plating Solution C), a copper(II) tetrafluoroborate/diethylenetriamine plating solution is disclosed with a pH of 5.4 and including 0.05M $Cu(BF_4)_2$, 0.6M Diethylenetriamine, and 0.15M $Co(BF_4)_2$. In another embodiment (i.e., Plating Solution D), the copper(II) tetrafluoroborate/diethylenetriamine plating solution is disclosed with a pH of 6.15 and including 0.05M $Cu(BF_4)_2$, 0.6M Diethylenetriamine, and 0.15M $Co(BF_4)_2$. It should be understood that the concentrations of the $Cu(BF_4)_2$, Diethylenetriamine, and $Co(BF_4)_2$ components of the copper tetrafluoroborate/diethylenetriamine plating solution can be adjusted to any value up to the solubility limit of the components so long as the resulting solution can effectuate an acceptable copper deposition rate for the pH setting of the solution.

In one embodiment, the formulation (i.e. Plating Solution C Formulation) of Plating Solution C is disclosed. In this embodiment, a 20.03 milliliter (mL) batch of Plating Solution C is formulated by initially adding about 13.2 mL of water ($H_2O$) to an appropriately sized container followed by about 1.0 mL of 1M $Cu(BF_4)_2$ solution, about 1.0 mL of 5M H $BF_4$ solution and about 1.3 mL of Diethylenetriamine (99%). The resulting mixture is then deoxygenated using Argon gas introduced to the mixture prior to the addition of about 3.53 mL of 0.85M $Co(BF_4)_2$ solution to complete the formulation of Plating Solution C.

Remaining with Table 11 in another embodiment, the formulation (i.e. Plating Solution D Formulation) of Plating Solution D is disclosed. In this embodiment, a 20.0 milliliter (mL) batch of Plating Solution D is formulated by initially adding about 13.47 mL of water ($H_2O$) to an appropriately sized container followed by about 1.0 mL of 1M $Cu(BF_4)_2$ solution, about 0.7 mL of 5M H $BF_4$ solution and about 1.3 mL of Diethylenetriamine (99%). The resulting mixture is then deoxygenated using Argon gas introduced to the mixture prior to the addition of about 3.53 mL of 0.85M $Co(BF_4)_2$ solution to complete the formulation of Plating Solution D.

Although a few embodiments of the present invention have been described in detail herein, it should be understood, by those of ordinary skill, that the present invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims. In the claims, elements and/or steps do not imply any particular order of operation unless explicitly stated in the claims.

What is claimed is:

1. An electroless copper plating solution, comprising:

an aqueous copper salt component;

an aqueous cobalt salt component;

a complexing agent that is a triamine compound; and a pH-modifying substance in an amount sufficient to make the electroless copper plating solution acidic, wherein, the pH-modifying substance is selected from a group consisting of sulfuric acid, nitric acid, hydrochloric acid, fluoroboric acid, and acetic acid.

2. The electroless copper plating solution, as recited in claim 1, wherein, the aqueous copper salt component is selected from a group of copper salts consisting of copper(II) sulfate, copper(II) nitrate, copper(II) chloride, copper(II) tetrafluoroborate, and copper(II) acetate.

3. The electroless copper plating solution, as recited in claim 1, wherein, the aqueous copper salt component is selected from a group of complex copper salts consisting of ethylenediamine copper(II) sulfate, bis(ethylenediamine) copper(II) sulfate, diethylenetriamine copper(II) nitrate, and bis(diethylenetriamine) copper(II) nitrate.

4. The electroless copper plating solution, as recited in claim 1, wherein, the aqueous cobalt salt component is selected from a group consisting of cobalt(II) sulfate, cobalt(II) nitrate, cobalt(II) chloride, cobalt(II) tetrafluoroborate, and cobalt(II) acetate.

5. The electroless copper plating solution, as recited in claim 1, wherein, the triamine compound is selected from a group consisting of diethylenetriamine, dipropylenetriamine, and ethylene propylenetriamine.

6. The electroless copper plating solution, as recited in claim 1, wherein, a pH of the electroless copper plating solution is between about 4.3 and about 4.6.

7. An electroless copper plating solution, comprising:

an aqueous copper salt component having a concentration between about 0.001 molarity (M) to a solubility limit for the aqueous copper salt component;

an aqueous cobalt salt component;

a complexing agent that is a triamine compound; and a pH-modifying substance in an amount sufficient to make the electroless copper plating solution acidic, wherein the pH-modifying substance is selected from a group consisting of sulfuric acid, nitric acid, hydrochloric acid, fluoroboric acid, and acetic acid.

8. The electroless copper plating solution, as recited in claim 7, wherein the pH-modifying substance is a buffer adjusting the electroless copper plating solution to a pH of between about 4.0 and about 6.4.

9. The electroless copper plating solution, as recited in claim 7, wherein, the aqueous copper salt component is selected from a group consisting of copper(II) sulfate, copper(II) nitrate, copper(II) chloride, copper(II) tetrafluoroborate, and copper(II) acetate.

10. The electroless copper plating solution, as recited in claim 7, wherein, the aqueous cobalt salt component is selected from a group consisting of cobalt(II) sulfate, cobalt(II) nitrate, cobalt(II) chloride, cobalt(II) tetrafluoroborate, and cobalt(II) acetate.

11. An electroless copper plating solution, comprising:

an aqueous copper salt component;

an aqueous cobalt salt component having a concentration between about 0.001 molarity (M) to a solubility limit for the aqueous cobalt salt component;

a complexing agent that is a triamine compound; and a pH-modifying substance in an amount sufficient to make the electroless copper plating solution acidic, wherein a pH of the electroless copper plating solution is between about 4.0 and about 6.4.

12. The electroless copper plating solution, as recited in claim 11, wherein, the aqueous copper salt component is selected from a group consisting of copper(II) sulfate, copper(II) nitrate, copper(II) chloride, copper(II) tetrafluoroborate, and copper(II) acetate.

13. The electroless copper plating solution, as recited in claim 11, wherein, the aqueous cobalt salt component is selected from a group consisting of cobalt(II) sulfate, cobalt (II) nitrate, cobalt(II) chloride, cobalt(II) tetrafluoroborate, and cobalt(II) acetate.

14. An electroless copper plating solution, comprising:

an aqueous copper salt component;

an aqueous cobalt salt component;

a complexing agent that is a triamine compound, wherein the complexing agent has a concentration between about 0.005 molarity (M) to about 10.0M; and a pH-modifying substance in an amount sufficient to make the electroless copper plating solution acidic, wherein a pH of the electroless copper plating solution is between about 4.0 and about 6.4.

15. The electroless copper plating solution, as recited in claim 14, wherein, the electroless copper plating solution is prepared by mixing a first mixture with a second mixture, wherein, the first mixture consists essentially of the aqueous copper salt component, the pH modifying substance, and a portion of the complexing agent; and the second mixture consists essentially of the aqueous cobalt salt component and a remainder of the complexing agent.

16. The electroless copper plating solution, as recited in claim 14, wherein, the electroless copper plating solution is prepared by sequentially combining the aqueous copper salt component to a volume of water, then adding the pH-modifying substance to the aqueous copper salt component/water combination, thereafter adding the complexing agent, and lastly adding the aqueous cobalt salt component.

17. A method for preparing an electroless copper plating solution comprising:

combining an aqueous copper salt component, a portion of a complexing agent and an acid as a first component;

combining an aqueous cobalt salt component and a remaining portion of the complexing agent as a second component; and mixing the first component and the second component prior to use in a deposition operation.

18. The method for preparing an electroless copper plating solution, as recited in claim 17, wherein, the aqueous copper salt component is selected from a group consisting of copper(II) sulfate, copper(II) nitrate, copper(II) chloride, copper(II) tetrafluoroborate, and copper(II) acetate.

19. The method for preparing an electroless copper plating solution, as recited in claim 17, wherein, the aqueous cobalt salt component is selected from a group consisting of cobalt(II) sulfate, cobalt(II) nitrate, cobalt(II) chloride, cobalt(II) tetrafluoroborate, and cobalt(II) acetate.

20. The method for preparing an electroless copper plating solution, as recited in claim 17, wherein, the complexing agent is a triamine compound.

* * * * *